US006075544A

United States Patent [19]

Malachowsky et al.

[11] Patent Number: 6,075,544

[45] Date of Patent: Jun. 13, 2000

[54] METHOD AND APPARATUS FOR ACCELERATING RENDERING BY COALESCING DATA ACCESSES

[75] Inventors: Chris Malachowsky, Santa Clara; Curtis Priem, Fremont; David Kirk, San Francisco, all of Calif.

[73] Assignee: Nvidia, Santa Clara, Calif.

[21] Appl. No.: 09/055,564

[22] Filed: Apr. 6, 1998

[51] Int. Cl.[7] ..... G09G 5/36

[52] U.S. Cl. ..... 345/509; 345/422

[58] Field of Search ..... 345/422, 507–509, 345/523, 515, 516

[56] References Cited

U.S. PATENT DOCUMENTS

| | | | |
|---|---|---|---|
| 5,767,856 | 6/1998 | Peterson et al. | 345/422 |
| 5,850,208 | 12/1998 | Poole et al. | 345/153 |
| 5,856,829 | 1/1999 | Gray, III et al. | 345/422 |

*Primary Examiner*—Kee M. Tung
*Attorney, Agent, or Firm*—Oppenheimer Wolff & Donnelly; Claude A. S. Hamrick; Stephen L. King

[57] ABSTRACT

A circuit for accelerating processing of pixel data being provided to a frame buffer comprising circuitry for determining that pixel values vary linearly over a scan line of a polygon to be rendered, linear interpolation circuitry for providing pixel values using a process of linear interpolation between accurately determined pixel values, and a circuit for collecting pixel values to be written to a frame buffer until a significant number of pixel values may be written together.

30 Claims, 3 Drawing Sheets

METHOD AND APPARATUS FOR ACCELERATING RENDERING BY COALESCING DATA ACCESSES

BACKGROUND OF THE INVENTION

1. Field of the Invention

This invention relates to computer systems, and more particularly, to methods and apparatus for accelerating the rendering of images to be reproduced on a computer output display.

2. History of the Prior Art

In three dimensional graphics, a picture is created on a display by scanning rows of pixels in sequence to paint a frame on the display. The pictures are made to change by following one frame by a next frame at a rate of approximately thirty frames per second. Each of these frames which appears on the display is defined by pixel data stored in frame buffer memory, typically local memory which is part of a graphics input/output circuit.

The pixel data is stored in the frame buffer at a position which controls where the pixel will appear when displayed. The pixel data is conventionally data defining the amount of each of three red, green, and blue colors that define the particular pixel. In a three dimensional display, the pixel data also includes data which allows the depth of the pixel to be determined with respect to a preceding pixel at the same point in the frame buffer.

An application program typically prepares the data to be sent to the frame buffer by defining the vertices of triangular or other polygonal areas which are graphically similar. This allows a great number of pixels to be represented by a minimal amount of pixel data. In three dimensional graphics, each vertex is described by its position in the frame, its depth, red/green/blue color values, and its position on a texture map which varies the color across the triangle. Various other data may also be included such as data to indicate how the triangle is to be treated with respect to the pixel data which already resides in the frame buffer for the same positions.

Since only the data defining the three vertices is provided by an application program, this data must be utilized to derive the position in the frame. Normally, the x and y values of the three vertices are defined by an application in screen space while the depth, the red/green/blue color values, and texture coordinates of each pixel in the triangle are defined in world space. The screen space values of the x and y coordinates of the vertices allow the positions of all pixels in a polygon to be obtained by linearly interpolating between the vertex values. The values of the other attributes at each pixel determined to lie within a polygon, however, must be converted from the world space in which they are furnished to screen space. Color values, depth, and texture coordinates are all linear in world space so a process involving linear interpolation and perspective transformation may be used to determine the color values, depth, and texture coordinates of each pixel. This is a complicated and computationally intense procedure.

After these attributes have been obtained for each pixel, the texture coordinates must be utilized to determine a texture value for each pixel in a texture map. A texture map is a matrix of values each defining a particular single color which is applied to vary color values of a pixel. Often a pixel, in fact, covers space on a texture map which involves several texture values. Consequently, in accurate texture mapping, obtaining final texture values is also a computationally intense procedure which greatly slows the graphics rendering process.

Once the texture values and other attributes of each pixel have been determined, they are used to define the r/g/b colors of each pixel. When the individual pixels are ready to write to the frame buffer, it is necessary to determine the manner in which each pixel is to be written to the frame buffer. This is typically determined from control data included with each pixel which determines the raster operation which is to take place. In many cases, a new pixel to be displayed depends both on the new pixel values and the values of the pixel held in the frame buffer; and the pixel data includes the control data to define this dependency. In general, the data of the pixel in the frame buffer must be read, combined with the new pixel data in the manner described by the new pixel control data, and written back to the frame buffer before a new pixel can be displayed.

With modern graphics displays which typically provide a depth value and five or eight bits of pixel color data for each of the three colors, a very large amount of pixel data must be read, manipulated, and written back to the frame buffer in a very short time. Prior art arrangements have been unable to accomplish these operations rapidly enough so that frames are not dropped when attempting to display rapidly changing graphics data.

It is desirable to increase the speed at which pixel data may be written to the frame buffer in a modem computer graphics display.

SUMMARY OF THE INVENTION

It is, therefore, an object of the present invention to provide an improved method for more rapidly producing values defining pixels representing three dimensional shapes typically to be presented on an output display.

These and other objects of the present invention are realized by a circuit for accelerating processing of pixel data being provided to a frame buffer comprising circuitry for determining that pixel values vary linearly over a scan line of a polygon to be rendered, linear interpolation circuitry for providing pixel values using a process of linear interpolation between accurately determined texture values, and a circuit for collecting pixel values to be written to a frame buffer until a significant number of pixel values may be written together.

These and other objects and features of the invention will be better understood by reference to the detailed description which follows taken together with the drawings in which like elements are referred to by like designations throughout the several views.

BRIEF DESCRIPTION ON THE DRAWINGS

DETAILED DESCRIPTION

Figure 1I:
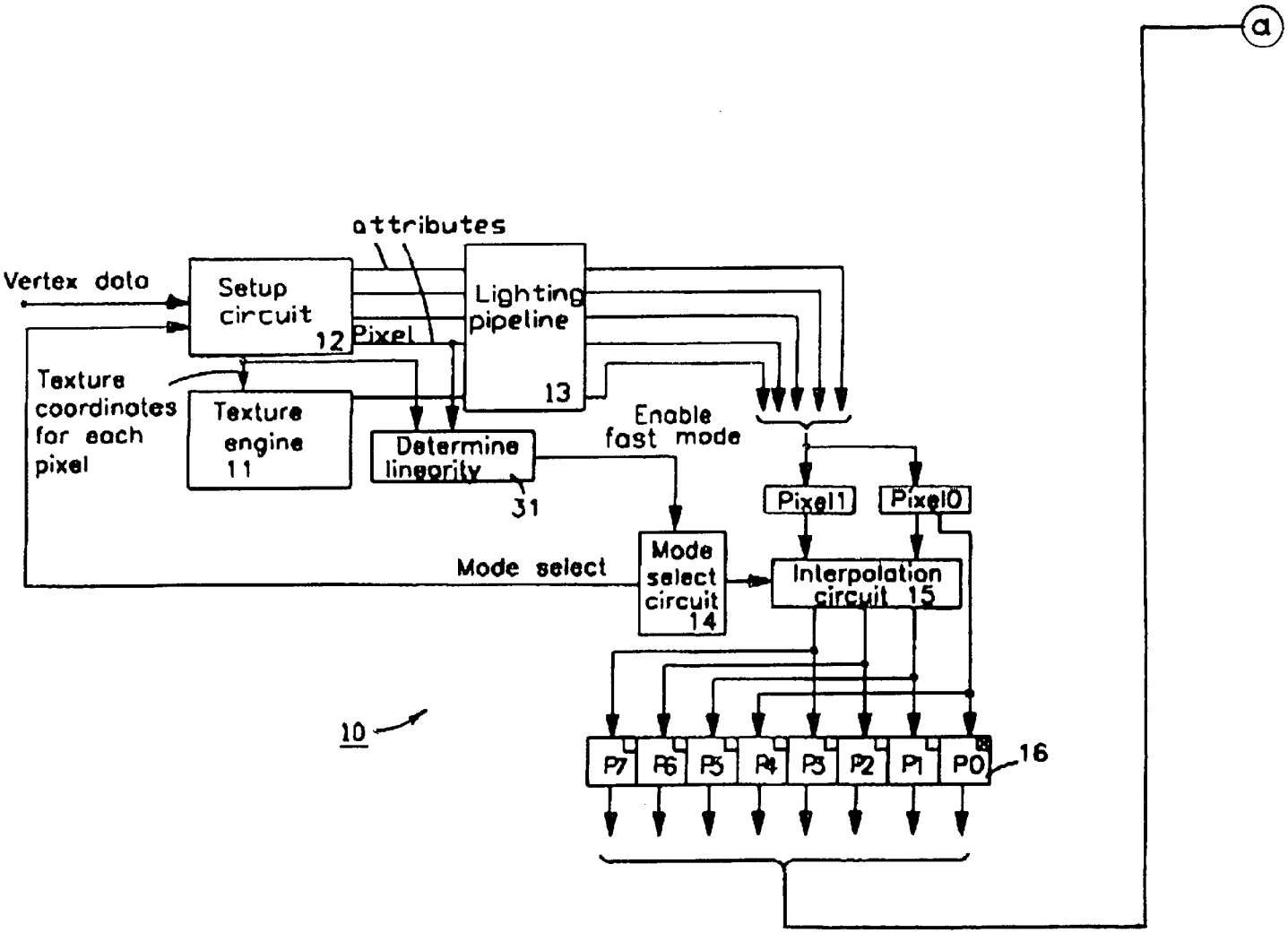
FIG. 1 is block diagram illustrating a circuit for practicing the present invention.
Figure 1:
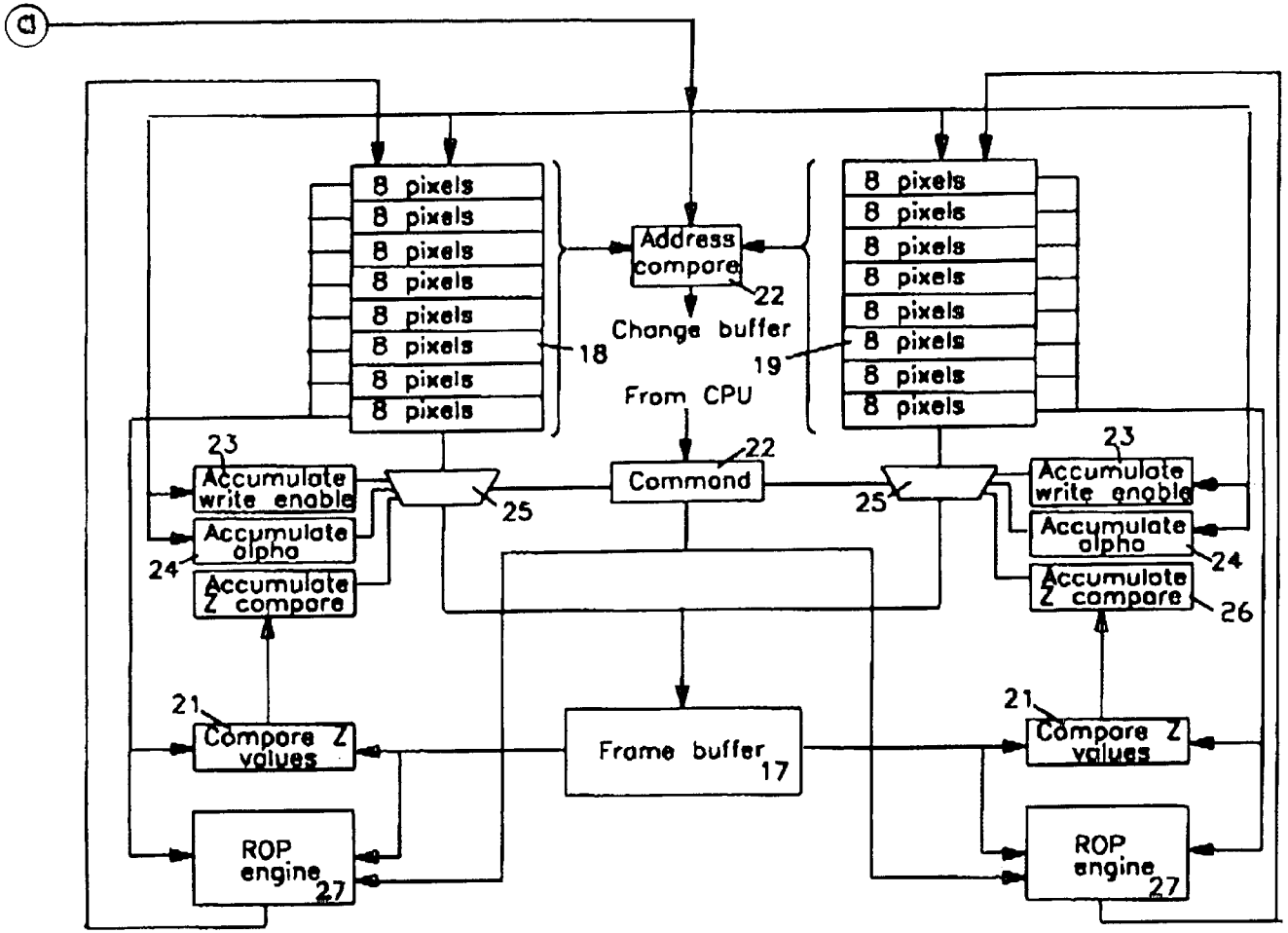
Figure 2:
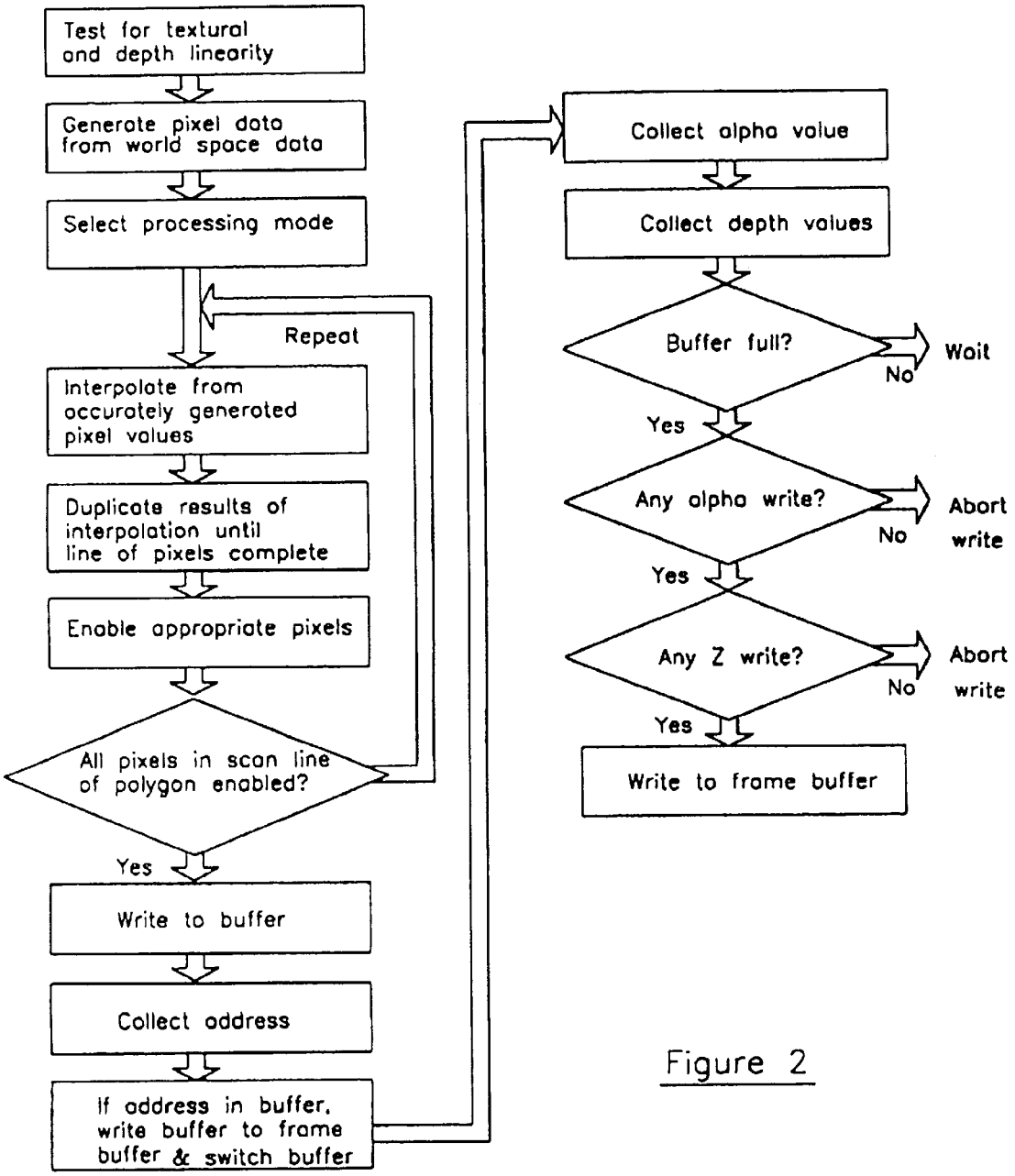
FIG. 2 is a flow chart illustrating the steps for rendering pixels to a frame buffer in accordance with the present invention.

FIG. 1 is a block diagram illustrating a circuit 10 which may be utilized in practicing the present invention. FIG. 2 illustrates the general process by which pixel information is placed in a frame buffer in accordance with the invention. The circuit 10 receives pixel data furnished by a setup circuit 12 as input. This data includes the pixel screen coordinates, r/g/b color values, the depth (or Z value), any enable bits (or similar bits), any alpha information, pixel mode, and any other data which might be necessary to write pixel data to the frame buffer.

The steps normally required for processing vertex values into the pixel attribute values which are combined by a lighting circuit 13 are accomplished by a setup process carried out by the setup circuit 12. The x and y coordinates assigned to the vertices of a particular triangle are furnished to the rasterizing engine which converts the world coordinates of the vertices into screen coordinates and determines the pixels encompassed within the triangle.

One embodiment of the circuit 12 for determining the attributes of each pixel translates any world space x and y coordinate values into screen space coordinates based on a perspective transformation process utilizing the following equations for conversion:

$$Xs=(H/S)*(X/Z);\ /*\ -1.0 \text{ to } 1.0\ */$$

$$Ys=(H/S)*(Y/Z);\ /*\ -1.0 \text{ to } 1.0\ */$$

$$M=(H/S)*(1/Z);\ /*\ 1/S \text{ to } H/S/F\ */$$

where, H is the distance from the viewer to the center of the screen; S is half of either the width or height of the screen; F is the distance from the eye to the far clip plane, and the field of view in degrees is 2*arctangent (S/H).

Once the pixels included in the triangle are determined, a process which combines linear interpolation in world space and perspective transformation to screen space is carried out by the setup circuit 12 to obtain a set of constants for the triangle. These constants are associated with the screen x and y coordinates for each of the pixels included in the triangle provide the color values, the depth values, and the textural coordinates for each of the pixels. One particular process of computing perspective-correct screen values for the attributes from world space vertex values is expressed by the geometric relationship:

$$E_s=(AX+BY+C)/(DX+EY+F),$$

where $E_s$ is the screen value of the particular attribute at the pixel defined by the X Y coordinates; and A, B, C, D, E, and F are constants over the triangle and depend on various dimensions of the triangle in screen and world space and the values of the attributes at the vertices in world space.

One specific sequence of operations which the circuit 12 may implement to provide accurate perspective translations rapidly from world space to screen space for a number of attributes when the values X and Y in the basic formula are screen values are as follows:

Where:

| | |
|---|---|
| A, B, C, D, E, F are the coefficients of the basic relationship | |
| Xs0, Xs1, Xs2 | Screen Coordinates of vertices |
| Ys0, Ys1, Ys2 | Screen Coordinates of vertices |
| Zs0, Zs1, Zs2 | Screen Z Buffer Coordinates of vertices |
| M0, M1, M2 | Screen Z Buffer Coordinates of vertices |
| R0, R1, R2 | World Red Lighting of vertices |
| G0, G1, G2 | World Green Lighting of vertices |
| B0, B1, B2 | World Blue Lighting of vertices |
| U0, U1, U2 | Texture Coordinates of vertices |
| V0, V1, V2 | Texture Coordinates of vertices |

-continued

```
Input: Xs, Ys                                   Screen Coordinates of pixels

Triangle Presetup

ad0 = Ys1 - Ys2;                                psu0 = Xs1*Ys2;
ad1 = Ys2 - Ys0;                                psu1 = Xs2*Ys1;
ad2 = Ys0 - Ys1;                                psu2 = Xs2*Ys0;
be0 = Xs2 - Xs1;                                psu3 = Xs0*Ys2;
be1 = Xs0 - Xs2;                                psu4 = Xs0*Ys1;
be2 = Xs1 - Xs0;                                psu5 = Xs1*Ys0;
cf0 = psu0 - psu1;                              adm0 = ad0*M0;
cf1 = psu2 - psu3;                              adm1 = ad1*M1;
cf2 = psu4 - psu5;                              adm2 = ad2*M2;
                                                bem0 = be0*M0;
                                                bem1 = be1*M1;
                                                bem2 = be2*M2;
                                                cfm0 = cf0*M0;
                                                cfm1 = cf1*M1;
                                                cfm2 = cf2*M2.

Triangle Setup

D = adm0          + adm1          + adm2;
E = bem0          + bem1          + bem2;
F = cfm0          + cfm1          + cfm2;
Zz = cf0          + cf1           + cf2;
Az = ad0*Zs0      + ad1*Zs1       + ad2*Zs2;
Bz = be0*Zs0      + be1*Zs1       + be2*Zs2;
Cz = cf0*Zs0      + cf1*Zs1       + cf2*Zs2;
Au = adm0*U0      + adm1*U1       + adm2*U2;
Bu = bem0*U0      + bem1*U1       + bem2*U2;
Cu = cfm0*U0      + cfm1*U1       + cfm2*U2;
Av = adm0*V0      + adm1*V1       + adm2*V2;
Bv = bem0*V0      + bem1*V1       + bem2*V2;
Cv = cfm0*V0      + cfm1*V1       + cfm2*V2;
Ar = adm0*R0      + adm1*R1       + adm2*R2;
Br = bem0*R0      + bem1*R1       + bem2*R2;
Cr = cfm0*R0      + cfm1*R1       + cfm2*R2;
Ag = adm0*G0      + adm1*G1       + adm2*G2;
Bg = bem0*G0      + bem1*G1       + bem2*G2;
Cg = cfm0*G0      + cfm1*G1       + cfm2*G2;
Ab = adm0*B0      + adm1*B1       + adm2*B2;
Bb = bem0*B0      + bem1*B1       + bem2*B2;
Cb = cfm0*B0      + cfm1*B1       + cfm2*B2;
Per Pixel operations:

Dd = D *Xs + E *Ys + F;
Zn = (Az*Xs + Bz*Ys + Cz)/Zz; /*screen*/
Zn = (                Zz)/Dd; /*world*/
Un = (Au*Xs + Bu*Ys + Cu)/Dd;
Vn = (Av*Xs + Bv*Ys + Cv)/Dd;
Rn = (Ar*Xs + Br*Ys + Cr)/Dd;
Gn = (Ag*Xs + Bg*Ys + Cg)/Dd;
Bn = (Ab*Xs + Bb*Ys + Cb)/Dd;
```

As will be understood by those skilled in the art, this sequence of steps may be implemented by well known gating circuitry which carries out the addition, subtraction, multiplication, and division steps indicated to produce perspective correct screen values for each of the attributes at each pixel position.

Once these steps have been accomplished, a texture engine 11 uses the texture coordinates determined for each pixel of the triangle to derive texture values to be assigned to each pixel. The texture coordinates for each pixel may be variously manipulated in order to find the texture values. For example, the texture values may be determined by rounding or truncating the texture coordinates to determine a closest texture value. The texture values may be determined more precisely by utilizing the integral portions of the texture coordinates to determine a plurality of texture values from the texture map at positions surrounding the pixel center. The weighted values of these texture values may be combined to reach a final texture value for each pixel. This and more advanced processes for determining texture values from the texture coordinates ascertained for the pixels may also include a first step of determining a scale for the texture map which is to be used in order to apply texture to the surface. These advanced processes require the manipulation of a very large amount of data and are very time consuming.

In the particular embodiment illustrated, pixel attribute data may be furnished from the lighting pipeline 13 in a number of different modes. These modes are referred to as a single pixel mode, a two pixel mode, and four pixel mode. Other embodiments of the invention might receive pixels in other modes as will be understood from the description. Although the invention may be used to accomplish other operations, the modes in the embodiment described other than the single pixel mode are adapted to utilize linear interpolation of pixel data to increase the speed of processing texture coordinates to determine color values.

The time required to precisely determine the value of each screen attribute for each pixel in a triangle including the texture mapping process and the process of combining the attributes in the lighting pipeline 13 for each pixel may be significantly reduced by limiting these precise calculations to some number of half or less of the pixels in any sequence of pixels defining the triangle. It is often sufficiently accurate to simply interpolate pixel values between the accurately determined values rather than utilizing the more rigorous methods for attribute determination, texture mapping, and combining. Linear interpolation takes very much less time and thus provides the ability to greatly accelerate the process of generating pixels for writing to the frame buffer.

If only every other pixel, or every third, fourth, fifth, or some other higher number of pixels in a sequence has its texture value precisely computed using an accurate method, and the values of the pixels between the accurately determined values are determined using linear interpolation of the values of the accurately determined pixels, the process of rendering pixels in such a sequence can be reduced to essentially one-half, one-third, one-fourth, one-fifth, or some smaller number depending on the fraction of pixels which are determined by linear interpolation. This allows pixels to be generated more rapidly than those pixels may be written to the frame buffer.

The two pixel and four pixel modes referred to above are used to practice linear interpolation of texture values in one embodiment. If it is determined that the rate of change of texture with respect to screen coordinates is such that the change is essentially linear, then the two pixel mode or the four pixel mode may be utilized.

The linearity circuit 31 receives the vertex data provided to the setup circuit 12 and the constants generated by the setup circuit 12 as input signals. The circuit 31 compares the change in the texture coordinates to the changes in pixels positions across a scan line. If the change in texture coordinates is small per pixel, then the texture attributes are considered to be varying linearly. If the texture attributes are varying linearly, then the ability of the setup circuit to produce attribute values at selectable x and y screen coordinates is utilized to generate perspective correct values utilizing the precise process for only selected pixels on a scan line.

This may be better understood by considering the relationship of texels and pixels. A pixel defines a position at which a single color is placed to display one position in a triangle. A texel represents a single value which may be used to determine which single color a pixel displays. If a pixel covers a number of texels, then many different texels should be evaluated to determine a final color for the pixel. If a pixel covers approximately one texel, then that texel might be the only texel considered in determining the color for that pixel; however, a different texel covered by the next pixel might be an entirely different color. If, on the other hand, a pixel covers less than one texel then adjacent pixels probably have the same or very similarly texture values since the color is assessed using the same texels. Consequently, by comparing the change in texture coordinates to the change in pixels over a scan line in a triangle (or some portion of a scan line or between the maximum and minimum x values in a triangle), a rate of change of one to the other may be determined which signifies that the change is linear.

The linearity of the pixels on a scan line may be determined in accordance with the following equations:

$$\delta u/\delta x=[(Au)/(DX+EX+F)]-[(AuX+BuY+Cu)D/(DX+EY+F)^2],$$

$$\delta v/\delta x=[(Av)/(DX+EX+F)]-[(AvX+BvY+Cv)D/(DX+EY+F)^2],$$

where the coefficients are those described above for setup circuit 12.

When the values resulting from the two equations are determined, the results are evaluated to provide a value which determines the mode in which to operate. In one embodiment, the results are added and if the sum is less than one-half, then mode two is selected; if the sum is less than one quarter, then mode four is selected. Other modes are possible in other embodiments.

The linearity circuit 31 may include circuitry which receives the u and v texture coordinates computed at the edges of each scan line of the triangle and determines the change of each u and v value with respect to the change of the x and y values for the scan line.

If texture is changing in a manner which is essentially linear, then one of the faster modes of generating pixels may be selected at a mode select circuit 14. In one embodiment of the invention, if the change in the texture coordinates from pixel to pixel on a scan line is less than one-half, then a fast mode is utilized. Specifically, if the change is less than one-half, then a fast mode of two is utilized; if the change is less than one-fourth, then a fast mode of four is utilized. A fast mode select input signal is provided by the mode select circuit 14 to the circuit 12 which generates x and y screen coordinates and to a linear interpolation circuit 15 to accomplish this. Although the different embodiments of the present invention actually increase the speed of pixel generation by two and four times; there is no theoretical reason that the speed cannot be increased by more by following the teachings of the present invention.

It should be noted that the changes in the u and v texture coordinates with respect to the changes in the pixel in the y direction may be computed in a similar manner by the linearity circuit 31 as are the changes in the u and v texture coordinates with respect to the changes in the pixel in the x direction using circuitry to accomplish the following steps:

$$\delta u/\delta y=[(Bu)/(DX+EX+F)]-[(AuX+BuY+Cu)E/(DX+EY+F)^2],$$

$$\delta v/\delta y=[(Bv)/(DX+EX+F)]-[(AvX+BvY+Cv)E/(DX+EY+F)^2],$$

where the coefficients are those described above.

The values which result may be evaluated to select modes for accomplishing linear interpolation of entire scan lines where changes in the y direction of the texture are linear.

If one of the fast modes for generating pixels is selected, a signal indicating the particular mode is furnished by the circuit 31 to the mode select circuit 14 of the circuit 10. If a fast mode is selected and linearity within an appropriate range is detected by the circuit 31, then the value of the first pixel in a particular stream of pixels is precisely calculated by the setup circuit 12 and sent to the lighting pipeline 13. The x and y coordinates of the pixels are used to align the stream of pixels sent to the input stage on four pixel intervals. Consequently, the first pixel data received is one which defines the first pixel of four pixels. This pixel may be placed in a register shown as pixel0 in the FIG. 1. In the two pixel mode, the next pixel in sequence is not calculated by the setup circuit 12 and furnished by the circuit 13; however, the third pixel in the sequence is calculated by the setup circuit 12 and furnished by the circuit 13 and placed in a register shown as epixel1. In the four pixel mode, the next three pixels in sequence after the first pixel are not calculated by the setup circuit 12 and furnished by the circuit 13; however, the fifth pixel in the sequence is calculated and furnished to the register pixel1. In particular embodiments, these accurately calculated pixels may be retained by the circuit 10 in some manner other than the registers illustrated.

Once the values of the first pixel and some succeeding pixel (e.g., the third or fifth in the embodiments described) are accurately generated and provided to the circuit 10, they are linearly interpolated (linearly averaged) to provide the intervening pixel values by the linear interpolation circuit 15. For example, in the two pixel mode where the pixels accurately determined are separated in the sequence by a single undetermined pixel value, the pixel values are typically added and divided by two to provide the values for the intervening pixel. If the pixels are separated by three pixels in the sequence for which the pixel values have not been furnished, the pixel values are typically added and divided by two to give the pixel value of the central pixel between the two. Then the value of the central pixel value is added to the value of the first pixel and divided by two to determine the second pixel value; and the central pixel value is added to the last pixel value and divided by two to obtain the value of the third pixel in the sequence. Typically, these computations are accomplished by circuitry well known to those skilled in the art such as adders and shifters. Since the precise values of the beginning and end pixels in a sequence determine the values of all of the intervening pixels, the values may be generated in sequence very rapidly.

The values determined are placed in the pipeline in each of the modes of operation by furnishing those values to a coalescing circuit 16. In the single pixel mode of operation, the computed single pixel data furnished is copied into each of the first four pixel positions of the coalescing circuit 16. In the two pixel mode, the first computed value and the middle interpolated value are placed in sequence in the first two positions of the coalescing circuit 16 and then duplicated in the same sequence in the third and fourth pixel positions. The first value and the three succeeding interpolated values are placed in the pipeline in the four pixel mode. This operation which provides redundant pixel values in the lower numbered modes is used in order to simplify the circuitry used in the invention. A write enable (shown as an X in the first P0 pixel position of the circuit 16) is provided with each pixel which is to be actually combined with any previous pixel data in the coalescing circuit 16 and written to the frame buffer in each of the modes. The use of write enable bits allows polygon edges to be precisely clipped and scan lines for individual polygons to be started at the correct pixel addresses. As will be seen, the use of write enable bits also allows the newly provided pixel data to be combined with other pixel data in a pipeline which works similarly for all of the pixel modes. This combining (or coalescing) of a number of pixels allows writes of more data to the frame buffer which makes better use of the available bandwidth of the graphics circuitry.

The four wide pixel front provided in each of the fast modes is doubled to eight pixels in the coalescing buffer 16. On a first write to the buffer 16, one of the eight pixels is enabled in the single pixel mode, up to two adjacent pixels are enabled in the two pixel mode, and up to four adjacent pixels are enabled in the four pixel mode. The coalescing buffer 16 collects pixels generated by the interpolation circuit 15 until up to eight enabled pixels are available for writing to the frame buffer. The particular embodiment of the invention is utilized with a frame buffer 17 which is addressed eight pixels at one time. Consequently, a complete access of all eight pixels of the frame buffer memory is usually available; and the speed of access is substantially increased.

With the single pixel mode, a series of eight individual pixels may be collected in the coalescing buffer 16 before writing to the frame buffer. In two pixel mode, a series of four sets of two pixels each may be collected in the buffer 16 before writing. In the four pixel mode, two sets of four pixels each may be calculated by the interpolation circuit 15 and collected by the buffer 16 before writing to the frame buffer. The number of pixels collected for writing to the frame buffer may be less or greater depending on the width of the bus to the frame buffer in the particular embodiment. Writes of sixteen and thirty-two pixels or greater would also be possible in a different embodiment utilizing a wider bus.

In single pixel mode, a first front of eight identical pixel values are generated for the coalescing buffer 16 in a first step. However, only enabled ones of these pixels are actually written to the buffer 16. Only one of these eight pixels is enabled in the single pixel mode, and the enabling indication is stored with the pixel data for that particular pixel of the eight written to the buffer 16. When the value of a next individually computed pixel is furnished to the buffer 16 in this single pixel mode, a set of four identical values are again initially generated by The interpolation circuit 15. This number is again doubled when presented to the buffer 16, but only one of these eight pixels is enabled. The circuitry compares the enabled pixel address to any pixel actually stored in that position in the coalescing buffer 16. Presuming that the enabled pixel is in a position different than any enabled pixel already in the coalescing buffer 16, the enabled pixel is written to the coalescing buffer 16 so that two enabled pixel values have been collected in the buffer 16. This generation and coalescing of enabled pixel values continues in the circuitry of the buffer 16.

Similarly, in two pixel mode, a leading edge of eight pixels of sequentially alternate values are generated for the coalescing buffer 16. At most two of these pixels are enabled, and the enabling indications are stored with the pixel data for the particular enabled pixels of the eight. When the values of the two next computed pixels are furnished to the buffer 16, a set of four pixels of alternating values are initially generated. This number is doubled when presented to the buffer 16, and maximally two of these eight pixel values are enabled. The four pixel mode functions similarly in comparing enabled pixels being written to the pixel positions in the buffer 16.

Collecting the pixels involved in a single memory transaction until eight pixels are available to be written to the frame buffer substantially increases the speed at which raster operations can be completed since pixels are typically written to the frame buffer eight at a time. In a particular embodiment in which other than eight pixels are written at once to the frame buffer, data for that number of pixels could be collected before a write to the frame buffer in order to match the rate of raster operations.

Even though this collecting of pixels allows an increase in speed to be attained through bursting writes, at least one embodiment of the invention significantly increases the speed of operation to an even greater extent. In this embodiment, when an eight pixel line of enabled pixels has been collected in the coalescing buffer 16, that line of pixel data is furnished to one of a pair of larger buffers 18 and 19. Each of the buffers 18 and 19 in one embodiment stores eight lines of eight pixels provided by the buffer 16, a total of sixty-four pixels to be written to the frame buffer.

In one embodiment, each line of eight pixels includes a write address and a depth value address for the eight pixels, as well as a write enable, color data, a depth value, and alpha values for each of the eight pixels. In certain embodiments, only a single write address for all eight pixels is provided since all eight pixels are written to the frame buffer at once. The depth address may also be eliminated and computed during the raster operation as an offset into the display memory from the pixel data position.

When sufficient data has been written to fill one of the buffers 18 or 19 which is receiving data, that data is transferred to the frame buffer in a burst. While data is being sent to the frame buffer from one of the two buffers 18 or 19, the other buffer is filling with pixel data from the coalescing buffer 16. In this manner, writes to the frame buffer usually occur only in blocks of eight sets of eight pixels each; and the speed of writing is significantly increased.

The speed with which writing or reading to the frame buffer is increased is attributable to at least two improvements accomplished by the invention. First, the latency caused by bus turnaround time in the transition between reading the frame buffer and writing to the frame buffer is significantly reduced. By writing and reading in bursts, the latency is amortized over a much larger amount of pixel data. Second, the need to initiate row address strobe operations between frame buffer accesses for operations related to depth and those related to pixel color produces another latency which is significant. By writing and reading in bursts, the present invention minimizes this latency as well.

In one embodiment of the invention, all pixels in any of the lines of eight pixels need not have been enabled for a write to the frame buffer to occur. For example, the data in one of the buffers 18 or 19 is possibly written to the frame buffer 17 whenever data describing an entire polygon has been completed. There are also other points at which the data in one of the buffers 18 or 19 is possibly written to the frame buffer. For example, if an enabled pixel is in one of the buffers 18 and 19 waiting to be written to the frame buffer and the pixel is thereafter varied in some manner, the buffer including the older of the two sets of data defining the pixel is immediately written to the frame buffer; while the newer pixel data is placed in the other buffer 18 or 19. The reason for immediately emptying the buffer is that since pixel data often has to be combined with data residing in the frame buffer before it replaces that data, if the pixel waiting to be written were to be overwritten by subsequent pixel values, an incorrect value could be in the frame buffer to be combined with the following pixel values.

Although the coalescing buffer 16 and the buffers 18 and 19 are illustrated as separate portions of the circuit 10, the coalescing function might also be incorporated into the buffers 18 and 19 in order to reduce the circuit complexity. In such a case, coalescing could occur in any of the individual lines of the buffers 18 and 19 until the data in that buffer is written to the frame buffer. Since could significantly increase memory access efficiency as well as buffer utilization efficiency.

The general process for writing data to a frame buffer is to read the Z (depth) value of the pixel data in the frame buffer at the address to be written and compare the Z value with the Z value of the new pixel data, read the color value in the frame buffer and combine with the new pixel colors in the ROP engine 27 in the manner described by the particular raster operation, write the combined colors back to the frame buffer, and write the new Z value back to the frame buffer. In the circuit 10 of FIG. 1, the ROP engine 27 should be considered as a general circuit capable of accomplishing all raster operations such as Boolean raster operations on colors, blends of colors, raster operations on depth values, and raster operations on stencil values, all of which are well known in the prior art.

The embodiment of the invention illustrated carries out this process for eight lines of eight pixels in order to completely drain one of the buffers 18 or 19. By coalescing the pixel data into lines of eight pixels and the combining eight lines of pixels before beginning to drain the buffers 18 and 19, there is hardly ever a delay to obtain new pixels before writing new values to the frame buffer. It will be understood by those skilled in the art that this significantly increases the speed of raster operations.

In one embodiment of the invention, a number of optimizations have been made which further increase the speed of operation. The manner in which data from the new and old pixels are combined in the various raster operations in the ROP engine 27 can depend on a number of different things which vary with the particular applications and commands which are executing. For example, in many cases, when pixel data is being written to the frame buffer, the data being written is to be positioned further from the screen than data already in the frame buffer and will not be shown. A comparison of the depth value of the pixel to be written with the depth value of the pixel already in the frame buffer (as in a comparison circuit 21) determines whether the new pixel is closer to the screen than the pixel in the frame buffer and should be displayed. If a new pixel is behind the pixel in the frame buffer, then, as a general rule, it is never written. If a new pixel is closer than the pixel in the frame buffer, then the new pixel would generally be combined with the pixel already in the frame buffer according to the control data. If the Z value determines whether pixels are to be written to the screen, then if no Z value in the entire buffer 18 or 19 is closer to the screen than the values in the frame buffer at identical pixel positions, none of the writes need take place.

In other cases, the manner of combination of the new and old pixel data may depend on the alpha value of the pixels, or both the alpha and Z values of the pixels. The raster operation may also be controlled by a control signal with the command (shown in command register 22) to always write the new data in place of the old data or a control signal to never write the new data in place of the old data. Knowledge of the values in the frame buffer and the data in the buffers 18 and 19 before the combination takes place allows entire steps in the raster operation to be eliminated. For example, by knowing that all of the pixels in the buffer are never to be written, the entire process may be eliminated. If a write depends on the alpha value and all of the pixels have an alpha value indicating no write is to take place, all of the steps in the process may be eliminated. A similar optimization may take place based on Z values. Other possibilities also exist.

Not only may an operation requiring combining an entire buffer of pixel data with data in the frame buffer be eliminated, the writing of individual lines of eight pixels to the frame buffer may similarly be eliminated by determining the pixel values in the buffer on a line by line basis. It is similarly reasonable to eliminate the combining and writing of data pertaining to individual pixels to the frame buffer for certain situations where speed could be increased.

In order to accelerate the operation, the buffers 18 and 19 are provided circuitry including the circuits for providing an early indication of alpha, Z, and the other signals which control the combining of data to be written to the buffer. The circuitry also includes logical circuitry shown as multiplexors 25 for responding to the results produced by the circuits 21, 23, and 26 and the commands in register 22 being executed for the particular raster operations and skipping those operations if the write operation will not be necessary. This also enhances the speed of operation of the present invention.

In one embodiment, the circuits 23 and 24 sense the alpha and write enables of pixels as they are placed in the buffers 18 and 19 and accumulate a result. If all alpha values are the same and that same value indicates that no write should occur, then no write of the new pixel data occurs and the entire raster operation is unnecessary. The simplest way to accumulate this result is a single bit which changes whenever an alpha value differs. A similar accumulation of write enable indications may be utilized to determine whether any pixel in the buffer should be written or the entire operation is unnecessary.

In a like manner, as the old Z data is read from the frame buffer and compared to the new Z data at the circuit 21, an indication that no pixels are to be written may be accumulated and the raster operation eliminated if no pixels in the buffer are to be written.

In all cases, the accumulation of the write enable indications determines whether any raster operation is to take place at all. Where conducting a raster operation depends on more than one of the factors determines whether an operation is to be conducted, the results of the accumulations and the control signals from the commands may be combined such as by logically ANDing the results in order to completely eliminate unnecessary raster operations and speed filling the frame buffer.

Those skilled in the art will recognize that similar techniques may be utilized to eliminate writing individual scan lines to the frame buffer.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A circuit for accelerating processing of pixel data being provided to a frame buffer comprising:

a circuit for determining attribute values for each pixel defining a polygon, a circuit for combining attribute values of each pixel defining a triangle to provide a pixel value for each pixel, a circuit for accumulating sequential pixels which can be directed to a frame buffer, and a circuit for providing burst accesses between the circuit for accumulating sequential pixels and a frame buffer.

2. A circuit as claimed in claim 1 in which the circuit for accumulating sequential pixels which can be directed to a frame buffer includes a buffer for storing a plurality of sequences of pixels for burst accesses with a frame buffer.

3. A circuit as claimed in claim 2 in which the circuit for accumulating sequential pixels which can be directed to a frame buffer includes a buffer for accumulating pixel data including pixel data read in bursts from a frame buffer which can be written in bursts to a frame buffer.

4. A circuit as claimed in claim 1 in which the circuit for accumulating sequential pixels which can be directed to a frame buffer includes a pair of buffers each capable of storing a plurality of sequences of pixels for burst accesses with a frame buffer, in which one of the pair of buffers accumulates a plurality of sequences of pixels which can be directed to a frame buffer while the other of the pair of buffers provides burst accesses with a frame buffer.

5. A circuit as claimed in claim 1 in which the circuit for determining attribute values for each pixel defining a polygon includes:

a circuit for determining whether attribute values of pixels vary linearly, a circuit for generating precisely only every one of a selected number of pixels of a sequence if attribute values of pixels vary linearly, circuit for linearly interpolating pixels between precisely generated pixels; and the circuit for accumulating sequential pixels which can be directed to a frame buffer is capable of accumulating pixels whether precisely generated or interpolated.

6. A circuit as claimed in claim 5 in which the circuit for accumulating sequential pixels which can be directed to a frame buffer is capable of accumulating pixels generated singly and in selected pluralities.

7. A circuit as claimed in claim 5 in which the circuit for accumulating sequential pixels which can be directed to a frame buffer is capable of accumulating pixel data from a frame buffer and a pixel generation pipeline.

8. A circuit as claimed in claim 1 further including a circuit for testing characteristics of pixels accumulated by the circuit for accumulating sequential pixels which can be directed to a frame buffer to determine if the frame buffer is to be accessed.

9. A circuit as claimed in claim 8 in which the circuit for testing characteristics of pixels accumulated tests a Z value of all pixels accumulated to determine if the frame buffer is to be accessed.

10. A circuit as claimed in claim 8 in which the circuit for testing characteristics of pixels accumulated tests a alpha value of all pixels accumulated to determine if the frame buffer is to be accessed.

11. A circuit as claimed in claim 8 in which the circuit for testing characteristics of pixels accumulated tests a plurality of characteristics of all pixels accumulated to determine if the frame buffer is to be accessed.

12. A circuit as claimed in claim 8 in which the circuit for testing characteristics of pixels accumulated tests write enables of all pixels accumulated to determine if the frame buffer is to be accessed.

13. A circuit as claimed in claim 1 further comprising a circuit responding to accumulation of a sequence of pixels which complete a polygon which sequence can be directed to a frame buffer for burst accessing pixels to and from a frame buffer.

14. A circuit as claimed in claim 1 further comprising a circuit responding to accumulation of a valid pixel having an address identical to the address of a pixel already accumulated in a sequence of pixels which can be directed to a frame buffer for burst writing the sequence of pixels to a frame buffer.

15. A circuit for accelerating processing of pixel data being provided to a frame buffer comprising:

a circuit for determining that pixel values vary linearly over a sequences in a polygon to be rendered, a circuit for generating pixels precisely at only every one of a selected number of pixels of a sequence if attribute values of pixels vary linearly, a circuit for linearly interpolating pixels between precisely generated pixels, and a circuit for collecting pixel values which can be written to a frame buffer until a significant number of pixel values can be written together.

16. A circuit as claimed in claim 15 in which the circuit for collecting pixel values which can be written to a frame buffer until a significant number of pixel values can be written together comprises a buffer for collecting a plurality of sequences of pixels defining a polygon.

17. A circuit as claimed in claim 15 in which the circuit for collecting pixel values which can be written to a frame buffer until a significant number of pixel values can be written together comprises a pair of buffers for collecting a plurality of sequences of pixels defining a polygon, and circuit means for selecting one buffer from which to write to a frame buffer and another buffer to accumulate pixel data to be written to a frame buffer.

18. A circuit as claimed in claim 15 further comprising a circuit for determining a type of operation to be practiced in writing the pixel data to the frame buffer, a circuit for comparing the type of operation to be practiced in writing the pixel data to the frame buffer with control data in the pixel data in the buffer, and a circuit for eliminating an operations if the control data indicates that pixel data would not be written in the particular operation.

19. A method for accelerating processing of pixel data being provided to a frame buffer comprising:

determining attribute values for each pixel defining a polygon, combining attribute values of each pixel defining a triangle to provide a pixel value for each pixel, accumulating sequential pixels which can be directed to a frame buffer, and providing burst accesses between accumulated sequential pixels and a frame buffer.

20. A method as claimed in claim 19 in which the step of accumulating sequential pixels which can be directed to a frame buffer includes accumulating pixel data read in bursts from a frame buffer which can be written in bursts to a frame buffer.

21. A method as claimed in claim 19 in which the step of accumulating sequential pixels which can be directed to a frame buffer includes storing a plurality of sequences of pixels to be written to a frame buffer together in a pair of buffers, and the step of providing burst accesses between accumulated sequential pixels and a frame buffer includes accumulating a plurality of sequences of pixels to be written to a frame buffer together in one buffer while writing a plurality of sequences of pixels to a frame buffer in a burst from the other buffer.

22. A method as claimed in claim 19 in which the step of determining attribute values for each pixel defining a polygon includes:

determining whether attribute values of pixels vary linearly, generating pixels precisely at only every one of a selected number of pixels of a sequence if attribute values of pixels vary linearly, linearly interpolating pixels between precisely generated pixels; and the step of accumulating sequential pixels which can be directed to a frame buffer includes accumulating pixels however the pixels are generated.

23. A method as claimed in claim 22 in which the step of accumulating sequential pixels to be written to a frame buffer is capable of accumulating pixels generated singly and in selected pluralities.

24. A method as claimed in claim 19 further including a step of testing characteristics of pixels accumulated during the step of accumulating sequential pixels which can be directed to a frame buffer to determine if the frame buffer is to be accessed.

25. A method as claimed in claim 24 in which the step of testing characteristics of pixels accumulated includes testing the Z value of all pixels accumulated to determine if the frame buffer is to be accessed.

26. A method as claimed in claim 24 in which the step of testing characteristics of pixels accumulated includes testing the alpha value of all pixels accumulated to determine if the frame buffer is to be accessed.

27. A method as claimed in claim 24 in which the step of testing characteristics of pixels accumulated includes testing a plurality of characteristics of all pixels accumulated to determine if the frame buffer is to be accessed.

28. A method as claimed in claim 24 in which the step of testing characteristics of pixels accumulated includes testing write enables of all pixels accumulated to determine if the frame buffer is to be accessed.

29. A circuit as claimed in claim 19 further comprising a step of responding to accumulation of a sequence of pixels to be written to a frame buffer which complete a triangle for burst writing the sequence of pixels to a frame buffer.

30. A method as claimed in claim 19 further comprising a step of responding to accumulation of a valid pixel having an address identical to the address of a pixel already accumulated in a sequence of pixels to be written to a frame buffer for burst writing the sequence of pixels to a frame buffer.

* * * * *